US008001776B2

(12) United States Patent
Wustefeld

(10) Patent No.: US 8,001,776 B2
(45) Date of Patent: Aug. 23, 2011

(54) HYDRAULIC CIRCUIT ARRANGEMENT WITH A DEVICE FOR LIMITING CONTROL AND METHOD FOR PRESSURE CONTROL BY CONTROLLING DISPLACEMENT

(75) Inventor: Martin Wustefeld, Neumuenster (DE)

(73) Assignee: Sauer-Danfoss Inc., Ames, IA (US)

( * ) Notice: Subject to any disclaimer, the term of this patent is extended or adjusted under 35 U.S.C. 154(b) by 527 days.

(21) Appl. No.: 12/198,233

(22) Filed: Aug. 26, 2008

(65) Prior Publication Data

US 2009/0133396 A1 May 28, 2009

(30) Foreign Application Priority Data

Nov. 27, 2007 (DE) ..... 10 2007 056 991

(51) Int. Cl.
*F04B 49/00* (2006.01)
*E02F 9/08* (2006.01)

(52) U.S. Cl. ..... 60/444; 60/452

(58) Field of Classification Search ..... None
See application file for complete search history.

(56) References Cited

U.S. PATENT DOCUMENTS 6,082,107 A * 7/2000 Schniederjan et al. ..... 60/444
6,336,324 B1 * 1/2002 Schniederjan et al. ..... 60/444
6,374,605 B1 * 4/2002 Dvorak et al. ..... 60/444

* cited by examiner

*Primary Examiner* — Thomas E Lazo

(57) ABSTRACT

The invention relates to a hydraulic circuit arrangement for setting the delivery volume of a pump, with an electrically activatable control-valve unit, by means of which, alternately, an active side of a servo system can be acted upon with pressure and, at the same time, its passive side can be relieved to the tank, and with a device for pressure limiting pressure regulation, which comprises pressure limiting valves, by means of which the working lines of the pump can be connected to the servo lines. To reduce the servo pressure load and improve the reaction time, check valves which shut off in the direction of the servo system are provided, by means of which the two servo sides can be connected in each case to the charge pressure via a relief line. Moreover, the device for Pressure limiting pressure regulation comprises an orifice which can be positioned in a line leading to the passive servo side. The invention relates, furthermore, to a method for pressure.

14 Claims, 2 Drawing Sheets

HYDRAULIC CIRCUIT ARRANGEMENT WITH A DEVICE FOR LIMITING CONTROL AND METHOD FOR PRESSURE CONTROL BY CONTROLLING DISPLACEMENT

BACKGROUND OF THE INVENTION

The invention relates to a hydraulic circuit arrangement for setting the displacement of a pump, with a device for pressure limiting control, according to the features of Claim 1, and to a method for pressure control by controlling the displacement according to the features of Claim 7.

Pumps which are often used together with hydraulic motors as hydraulic transmissions in hydrostatic travel drives have a stroking mechanism, by means of which the displacement of the machine can be varied. For this purpose, the pumps possess, for example, an angularly adjustable swashplate on which the pistons located in a rotating cylinder block are supported. The displacement generated by the pistons is set indirectly via the pivot angle of the swashplate. The latter is adjusted by means of a servo system, for example a piston movable in a cylinder, the movement of which is regulated via a control-valve unit, called a control, which can be activated electrically via magnets or manually. By means of the control, one of the two servo sides is acted upon alternately with pressure. At the same time, the other side is relieved towards the tank via suitably dimensioned orifices. The side connected to the charge pressure from the control is designated as the "active servo side". The "passive servo side" is the side connected to the tank via the control.

Pressure limiting operation is set by means of pressure-limiting valves, which are connected to the working lines and connect the servo lines to the working lines of the pump in such a way that, for example during normal pump operation, the pressure limiting valve opens the high-pressure side of the pump towards the passive servo side when the pressure setting of the pressure limiting valve is reached. Although pump operation is by far the most predominant type of operation, the motor operation of the pump, dependent on the driving state of the vehicle, for example, an overrun operation downhill, also has to be taken into account. With the control being activated identically, in motor operation, the high-pressure sides alternate. In this case, different effects are achieved by means of pressure limiting regulation. When the unit is in pump operation, corresponding to the driving states of "normal drive" or "acceleration", when the pressure limit is reached the pivot angle of the unit is reduced and the high pressure is regulated to the set value. In motor operation, that is to say in "braking or overrun operation" of the vehicle, by contrast, the pivot angle is increased when the pressure setting is reached, so that the displacement generated, in this case by the hydraulic motor, can be absorbed.

The use of the abovementioned pressure limiting valves results, as a function of time, depending on the orifices present in the inflows and return flows to and from the servo system, in a considerable pressure load and in adverse reaction times, in particular too long pivot-back times in which the pressure load persists for a correspondingly long time.

The object of the invention is therefore to provide a system for setting the displacement of a pump with improved pressure limiting pressure regulation.

SUMMARY OF THE INVENTION

According to the invention, the object is achieved by means of a hydraulic circuit arrangement for setting the displacement of a pump which has an electrically activatable control-valve unit, by means of which, alternately, an active side of a servo system can be acted upon with pressure and, at the same time, its passive side can be relieved to the tank. The circuit arrangement has a device for pressure limiting pressure regulation which comprises pressure limiting valves, by means of which the working lines of the pump can be connected to the servo lines. According to the invention, in this case, check valves are provided, which shut off flow in the direction of the servo system and by means of which the two servo sides can be connected in each case to the pressure via a relief line. Furthermore, the device for pressure limiting pressure regulation comprises a supporting orifice which can be positioned in a line leading to the passive servo side.

In a preferred version, the supporting orifice is formed in each case in the slides of two orifice valves, which are provided in each case on the charge pressure side, downstream of the check valves, in the relief line to the charge pressure. Alternatively, the orifice is formed in each case in the spool of orifice valves which in each case switch the servo lines leading from the control-valve unit to the servo system into two switching positions, to be precise "pass" and "inserted orifice".

The spools of the orifice valves are in this case preferably actuated hydraulically, while the pressure limiting valves are designed as pressure-limiting valves, the set pressure of which is fixed by the preload of an adjustable spring. Moreover, for reasons of operating safety, a charge pressure valve is provided in the charge pressure line and, in the event of any excess pressure, opens a connection to tank.

Moreover, the object is achieved by means of a method for pressure regulation in the pressure limiting operation of a servo system by means of which the displacement of a pump can be adjusted, a device for pressure limiting pressure regulation being provided, which comprises pressure limiting valves, by means of which the working lines of the pump can be connected to the servo lines. The method comprises pump operation, with the steps: connection of the active servo side to the charge pressure via a relief line in which a check valve with a large orifice is provided, and positioning of an orifice in a line leading to the passive servo side.

In a further object of the invention, in pump operation, the orifice is positioned in the relief line, downstream of the check valve of the passive servo side, or, alternatively, in the servo line leading from the control-valve unit to the passive servo side.

In the method according to the invention, preferably, motor operation of the pump is also provided, with the following steps: connection of the passive servo side to the charge pressure via a relief line in which a check valve with a large orifice is provided, and positioning of an orifice in a line leading to the active servo side.

In developments of motor operation, the orifice is positioned in the relief line, downstream of the check valve of the active servo side, or in the servo line (10) leading from the control-valve unit (11) to the active servo side (8) Further features and advantages of the invention may be gathered from the following description of the figures.

DETAILED DESCRIPTION OF THE PREFERRED EMBODIMENTS

Figure 1:
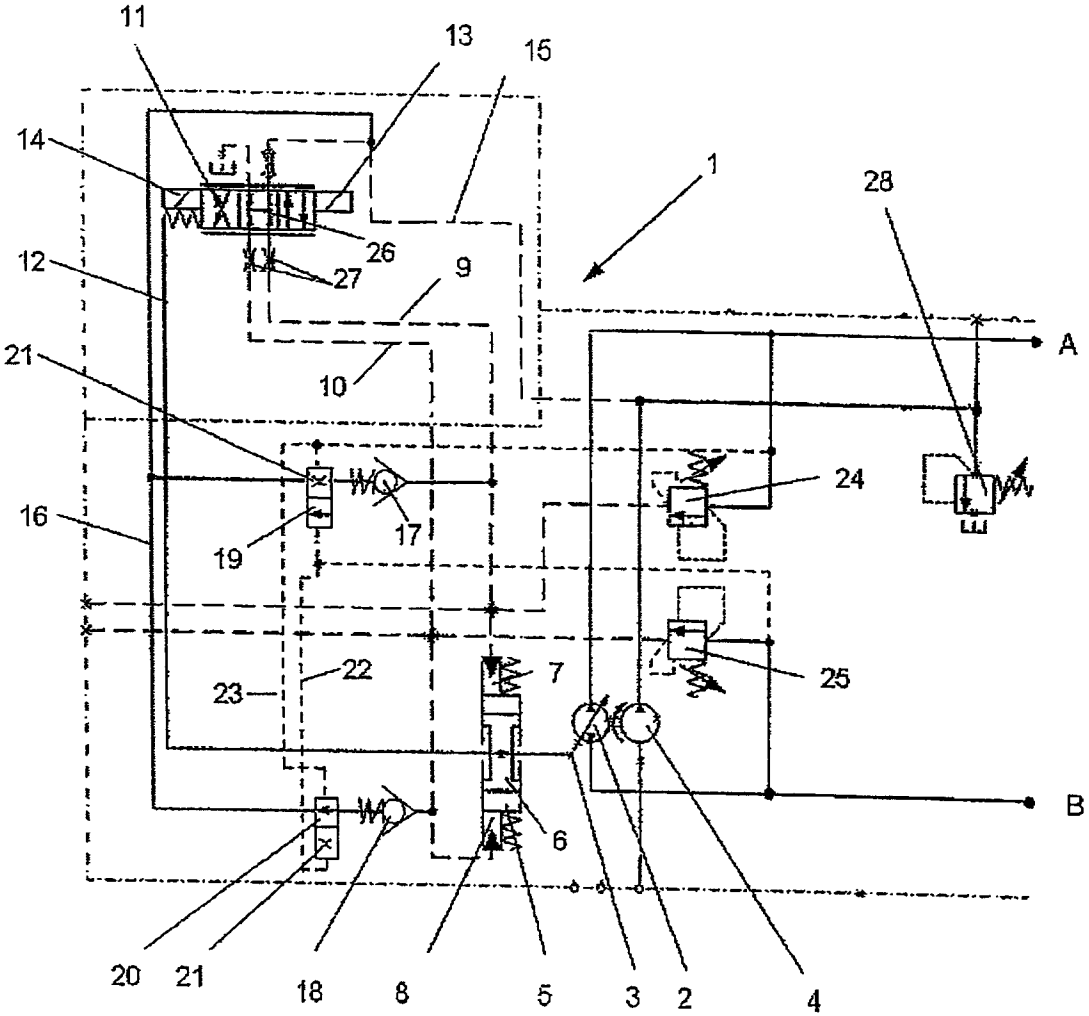
FIG. 1 shows a first exemplary embodiment of the invention.

FIG. 1 shows the hydraulic circuit arrangement 1 according to the invention by means of a first exemplary embodiment. An adjustable pump 2 supplies, for example, a hydraulic motor, not illustrated, via the working lines A, B. In normal pump operation, high pressure prevails in the line A and, correspondingly, low pressure prevails in the return line B. This may be reversed (motor operation), as described in the introduction, under specific conditions. Together with the pump 2, a charge pump 4 is also operated, which provides the charge pressure for the servo system 5, 6 via the charge pressure line 15. For the charge pressure line 15, a pressure-limiting valve in the form of the charge pressure valve 28 is provided, which releases a connection to the tank when a predetermined pressure is overshot.

The pump 2 possesses an adjusting mechanism for setting the displacement, as illustrated diagrammatically in the figure by the pivoting device 3. The pivoting device 3 is actuated by a servo piston 6 which can be moved inside the servo cylinder 5. When the servo side 8 is acted upon with pressure via the servo line 10, the pivot angle is increased, Conversely, it is reduced when the action of pressure takes place via the servo line 9 and the servo side 7. The movement of the servo piston 6 is controlled by a control-valve unit 11, what is known as a control, which is activated electrically by proportional magnets 13, 14 or is actuated manually. In this case, one of the two servo sides is acted on with charge pressure by the servo lines 9, 10 by means of orifice 27 (active servo side), while the other (passive servo side) is relieved towards the tank via a further suitable orifice. To regulate the pump 2 to the desired pivot angle, a mechanical pivot-angle feedback 12 is provided, by means of which the position of the servo piston is transmitted back to the valve spool 26 of the control-valve unit 11 and the control loop is closed with respect to the pivot angle.

The servo line 9 and consequently the servo side 7 are connected to the working line A by the pressure limiting valve 24. In the same way, the second pressure limiting valve 25 connects the servo line 10 and the servo side 8 to the working line B. The pressure limiting valves 24, 25 are pressure-limiting valves which open the respective connection to the servo lines when a predetermined pressure is reached in the working lines to the pump. To avoid the pressure peaks occurring in this case and to improve the reaction time, the servo lines 9, 10 are connected in each case via check valves 17, 18 to the connecting line 16 and by the latter to the charge pressure line 15. The check valves 17, 18 are followed in each case downstream by a hydraulically actuated orifice valve 19, 20 in the form of a spool, which, in one position, is switched to pass oil and, in the second position, introduces an orifice 21 into the relief line. Normally, when high pressure prevails in the working line A and consequently also in control line 23 (the control line 22 then carries low pressure), the orifice valve 19 responsible for the servo side 7 is pushed, as illustrated, into the position with an orifice 21, while the spool of the orifice valve 20 on the servo side 8 is switched to as unimpeded a passage as possible.

The functioning of the circuit is described below by way of an example in which the magnet 14 is activated and the servo side 8 represents the active servo side.

When the magnet 14 is activated, a servo pressure is generated on the servo side 8. This is high pressure in the working line A and low pressure on the side B. As long as the high pressure in the line A is lower than the pressure setting of the pressure limiting valve 24, the pump is regulated via the control-valve unit 11 to a pivot angle which corresponds to the current on the magnet 14. The orifice valve 19 is in the throttling position illustrated in FIG. 1, because one end face is connected to high pressure A and the opposite side is connected to the pressure of the line B. By contrast, as illustrated, the other orifice valve 20 is in the passing position. If, then, the high pressure reaches the setting of the pressure limiting valve 24, the latter opens and a fluid flows via the servo line 9 onto the servo side 7. A pressure build-up takes place first here, because this passive servo side 7 is connected to the tank via the orifice 27 of the valve control unit 11 and the throttle resistance in the control spool 26 and, moreover, the orifice valve 19 is in the throttling position. Owing to the instantaneous pressure build-up on the passive servo side 7, the servo piston 6 is rapidly pushed back in the direction of a reduction in the pivot angle. The oil in this case displaced can flow out without appreciable resistance via the opening check valve 18 and the orifice valve 20, located in the passing position, into the charge pressure line. Without the check valve 18, the oil displaced on the active servo side 8 would only have the possibility of flowing out to the tank via the orifice 27 of the control-valve unit 11 and would generate a corresponding throttling effect.

As soon as the pivot-back operation has ended and the pump 2 has pivoted back to an angle which makes it possible to hold the high pressure set at the pressure limiting valve 24, the two check valves 17, 18 are closed again, because, as before, the servo side 8 is connected to the charge pressure and the servo pressure on the servo side 7 required for regulating the pivot angle, is always lower than the charge pressure on account of the spring energy of the servo system.

When the high-pressure sides alternate in motor operation, the pressure limiting valves 24, 25 act in each case on the other servo side. In this instance, the pressure limiting valve 25 acts on the active servo side 8. Whereas, in pump operation, the pivot angle of the pump is to be reduced when the pressure setting of the pressure limiting valve is reached, in overrun operation the pivot angle is then to be increased and receives the displacement coming from the hydraulic motor. The switchable orifice 21 is actuated by the high pressure. It is therefore always switched for the pressure limiting valve active in each case.

Figure 2:
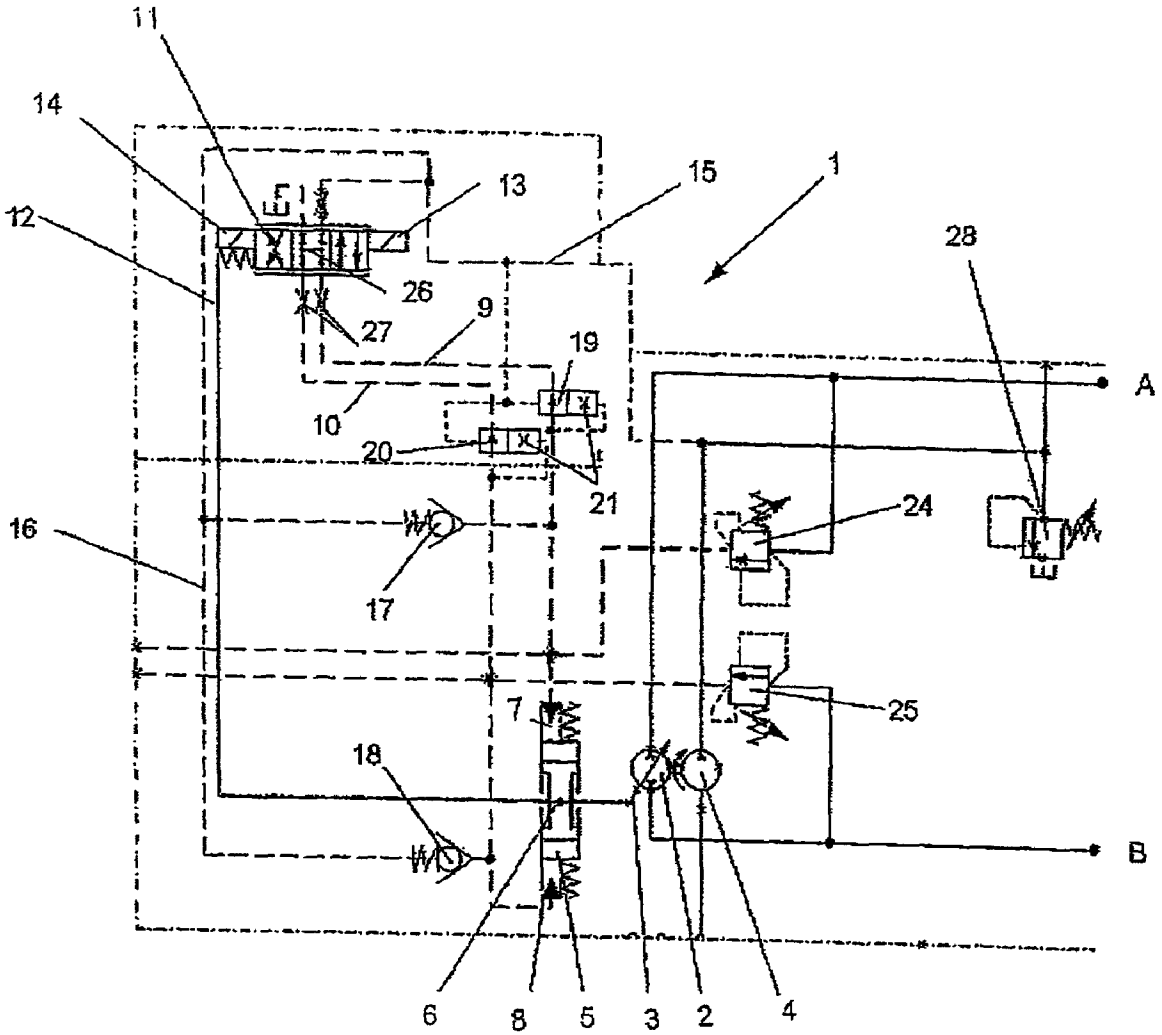
FIG. 2 shows a second exemplary embodiment.

FIG. 2 shows a second exemplary embodiment of the invention, the reference symbols for identical circuit parts having been retained. The circuit arrangement largely corresponds to that according to FIG. 1, to the description of which reference is made.

According to the exemplary embodiment of FIG. 2, too, the pressure limiting valves 24, 25 connect the working lines A, B of the pump 2 to the servo lines 9, 10, as described above, so that the respective servo side is acted upon with high pressure when the pressure setting of the pressure limiting valve is overshot. For the rapid breakdown of pressure peaks which occur, once again, the servo lines 9, 10 are connected to the charge pressure via check valves 17, 18 or the relief line 16. In contrast to the exemplary embodiment described above, the orifice valves 19, 20 in this case lie in the servo lines 9, 10. Their slides are actuated hydraulically, specifically, on the one hand, via a connection to the charge pressure line 15 and, on the other hand, by the pressure in the servo lines 9, 10.

The operation of the circuit arrangement illustrated in FIG. 2 corresponds to that described above. It may be assumed, again, that a servo pressure is generated on the servo side 8 and high pressure in working line A by the control-valve unit 11. As long as this is lower than the pressure setting of the pressure limiting valve 24, the pump is regulated to a pivot angle which is predetermined by the control-valve unit 11. The orifice valves 19, 20 are in the passage position illustrated in FIG. 1. When the high pressure in the working line A reaches the setting of the pressure limiting valve 24, the latter opens and fluid flows onto the passive servo side 7. A pressure build-up first takes place here and displaces the orifice valve 19 into the throttling position, with the result that the resistance in the servo line 9 rises correspondingly. By means of the dynamic pressure thus intensified, the servo piston 6 is moved back in the direction of a reduction in the pivot angle. The pressure increased thereby on the active servo side 8 also pushes the other orifice valve 20 into the throttling position. The displaced oil, however, can flow out without appreciable resistance via the opening check valve 18 into the charge circuit, as a result of which, at the same time, the losses to the tank are minimized. The check valve 17, 18 must in this case have a suitable flow resistance, in order to ensure the required orifice on the servo side acted upon by the active pressure limiting valve.

In motor operation, the pressure limiting valve 25 operates on the active servo side 8 and causes the intended increase in the pivot angle, on the passive servo side the circuit arrangement according to the invention once again ensuring that the displaced oil flows out, as far as possible unimpeded, into the charge circuit.

The circuit arrangement according to the invention and the associated method make it possible, independently of the respective control orifice, to have a faster reaction time, along with a markedly lower servo pressure load. At the same time, the flow which flows to the tank and which is to be seen as a loss and has to be replenished up again by the charge pump is reduced. By contrast, the oil flowing via the check valves flows into the charge circuit where it is fed in directly on the low-pressure side again.

The invention claimed is:

1. Hydraulic circuit arrangement for setting the delivery volume of a pump (2), with an electrically activatable control-valve unit (11), by means of which, alternately, an active side (8) of a servo system (5, 6) can be acted upon with pressure and, at the same time, its passive side (7) can be relieved to the tank, and with a device for pressure limiting pressure regulation, which comprises pressure limiting valves (24, 25), by means of which the working lines (A, B) of the pump (2) can be connected to the servo lines (9, 10), check valves (17, 18) which shut off in the direction of the servo system (5, 6) being provided, by means of which the two servo sides (7, 8) can be connected in each case to the charge pressure via a relief line (16), furthermore the device for pressure limiting pressure regulation comprising an orifice (21) which can be positioned in a line leading to the passive servo side (7).

2. Hydraulic circuit arrangement according to claim 1, in which an orifice (21) is formed in each case in the spool of two orifice valves (19, 20) which are provided in each case on the charge pressure side, downstream of the check valves (17, 18), in the relief line (16) to the charge pressure.

3. Hydraulic circuit arrangement according to claim 2, in which the spools of the orifice valves (19, 20) can be actuated hydraulically.

4. Hydraulic circuit arrangement according to claim 1, in which the orifice (21) is formed in each case in the spool of two orifice valves (19, 20) which are provided in each case in the servo lines (9, 10) leading from the control-valve unit (11) to the servo system (5, 6).

5. Hydraulic circuit arrangement according to claim 1, in which the pressure limiting valves (24, 25) are designed as pressure-limiting valves.

6. Hydraulic circuit arrangement according to claim 1, in which a charge pressure valve (28) which opens a connection to the tank in the event of excess pressure is provided in the charge pressure line (15).

7. Method for pressure regulation in the pressure limiting operation of the servo system (5, 6), by means of which the delivery volume of a pump (2) can be adjusted, a device for pressure limiting pressure regulation being provided, which comprises pressure limiting valves (24, 25), by means of which the working lines (A, B) of the pump can be connected to the servo lines (9, 10), and, in pump operation, the method comprising the following steps: Connection of the active servo side (8) to the charge pressure via a relief line (16) in which a check valve (18) with a large orifice is provided, and positioning of an orifice (21) in a line leading to the passive servo side.

8. Method according to claim 7, in which the orifice (21) is positioned in the relief line (16), downstream of the check valve (17) of the passive servo side (7).

9. Method according to claim 7, in which the orifice (21) is positioned in the servo line (9) leading from the control-valve unit (11) to the passive servo side (7).

10. Method according to claim 9, in which, additionally, a further orifice (21) is positioned in the servo line (10) leading from the control-valve unit (11) to the active servo side (8).

11. Method according to claim 7, in which the method comprises motor operation of the pump, with the following steps: Connection of the passive servo side (7) to the charge pressure via a relief line (16) in which a check valve (17) with an orifice is provided, and positioning of an orifice (21) in a line leading to the active servo side.

12. Method according to claim 11, in which the orifice (21) is positioned in the relief line (16), downstream of the check valve (18) of the active servo side (8).

13. Method according to claim 11, in which the orifice (21) is positioned in the servo line (10) leading from the control-valve unit (11) to the active servo side (8).

14. Method according to claim 13, in which, additionally, a further orifice (21) is positioned in the servo line (9) leading from the control-valve unit (11) to the passive servo side (7).

* * * * *